US008360705B2

(12) United States Patent
Oohori et al.

(10) Patent No.: US 8,360,705 B2
(45) Date of Patent: Jan. 29, 2013

(54) CAN SEAMER

(75) Inventors: Kei Oohori, Kanagawa (JP); Sunao Morishita, Kanagawa (JP); Kazuhiro Tokunaga, Shizuoka (JP); Koichi Ishizaka, Shizuoka (JP); Yasuo Kumano, Hiroshima (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 510 days.

(21) Appl. No.: 12/666,965

(22) PCT Filed: Jun. 28, 2007

(86) PCT No.: PCT/JP2007/062999

§ 371 (c)(1),
(2), (4) Date: Dec. 28, 2009

(87) PCT Pub. No.: WO2009/001459

PCT Pub. Date: Dec. 31, 2008

(65) Prior Publication Data

US 2010/0196123 A1 Aug. 5, 2010

(51) Int. Cl.
*B21D 51/32* (2006.01)

(52) U.S. Cl. ..... 413/31

(58) Field of Classification Search ..... 413/27, 413/31, 37, 72, 74, 2, 4–7; 72/125, 379.4, 72/107, 110

See application file for complete search history.

(56) References Cited

U.S. PATENT DOCUMENTS

| | | | | |
|---|---|---|---|---|
| 5,358,369 | A * | 10/1994 | Katou et al. | 413/27 |
| 6,151,942 | A * | 11/2000 | Itaya | 72/137 |
| 2009/0200321 | A1 | 8/2009 | Oohori et al. | |

FOREIGN PATENT DOCUMENTS

| | | | |
|---|---|---|---|
| JP | 2001-259766 | A | 9/2001 |
| JP | 2005-000930 | A | 1/2005 |
| JP | 2007-014982 | A | 1/2007 |
| JP | 2007-229730 | A | 9/2007 |
| WO | 2006/123637 | A1 | 11/2006 |

OTHER PUBLICATIONS

International Search Report of PCT/JP2007/062999, mailing date of Sep. 25, 2007.

Notification of Transmittal of Translation of the International Preliminary Report on Patentability (Forms PCT/IB/338) of International Application No. PCT/JP2007/062999 mailed Feb. 4, 2010 with Forms PCT/IB/373 and PCT/ISA/237.

Supplementary European Search Report dated Apr. 4, 2011, issued in corresponding European Patent Application No. 07767793.8.

* cited by examiner

*Primary Examiner* — Edward Tolan
*Assistant Examiner* — Matthew G Katcoff
(74) *Attorney, Agent, or Firm* — Westerman, Hattori, Daniels & Adrian, LLP

(57) ABSTRACT

In seaming various shapes of cans, there is no need of replacement of a profiling cam or experience in techniques, thus enabling to reduce the number of components to be replaced and simplify a replacement work remarkably. Below a rotary driving ring (10), a holding ring (4) is mounted in such a manner that it can move horizontally and rotate integrally. Inside the holding ring (4), a curl roller (2) and a tightening roller (3) are mounted opposite to each other. The holding ring (4) is so mounted on a guide ring (6) as to be turned via a pressurization roller (5). The guide ring (6) is drive-controlled in the X-axis direction and Y-axis direction by an X-axis table (7) and a Y-axis table (8) driven by servo motors (14, 16) according to the shape of a can.

3 Claims, 4 Drawing Sheets

FIG. 5B
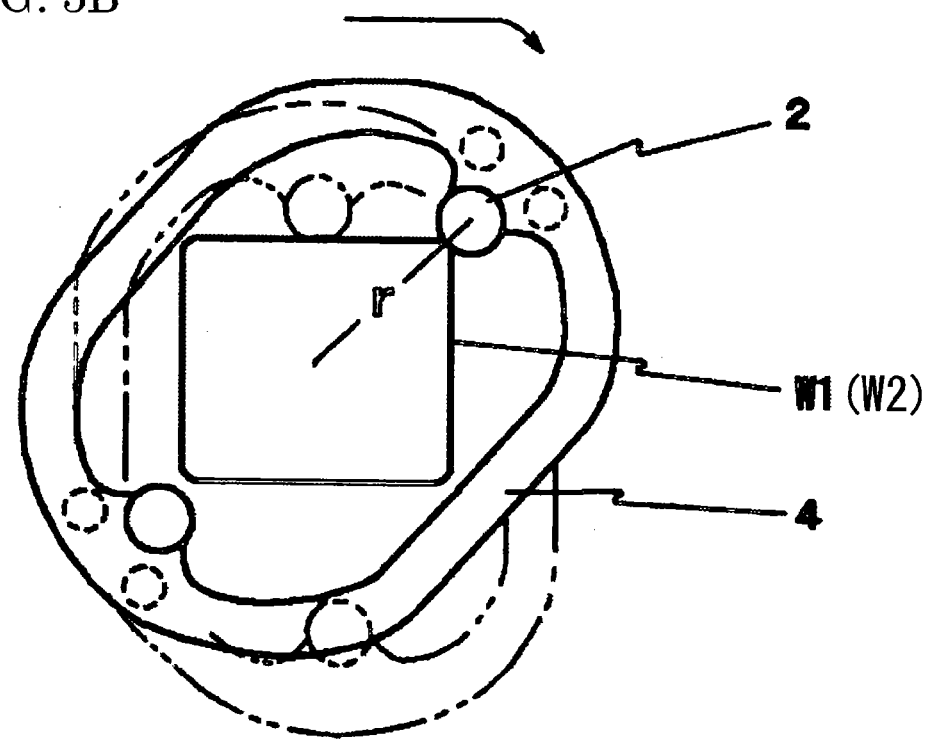
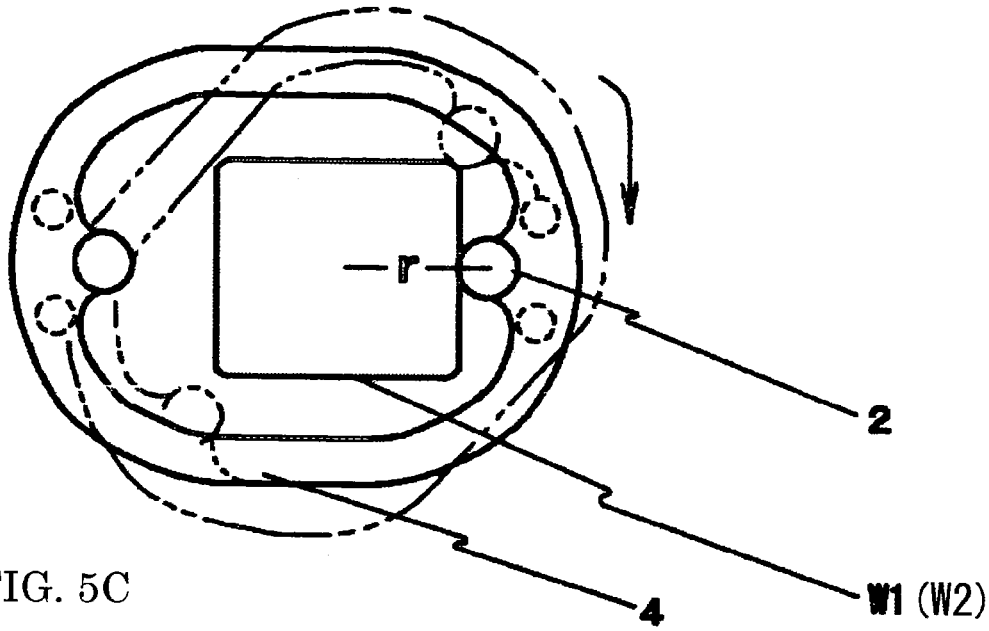
FIG. 5C

CAN SEAMER

TECHNICAL FIELD

The present invention relates to a can seamer that can process cans of rectangular shape or cans of different size or shape, without using a profiling cam.

BACKGROUND ART

In a case where cans of rectangular shape or cans of different size and shape are manufactured by seaming a lid to an end portion of a can body by using a curl roller and a tightening roller, a profiling cam has been conventionally prepared that matches the cross-sectional shape of the can body and the can seaming operation has been performed by moving the curl roller and tightening roller with respect to the transverse section of the can. In this case, each time the cross-sectional shape of the can body changes, a new profiling cam has to be used, and the profiling cam replacement is a time-consuming and troublesome operation. Therefore, the automatic production line is stopped when the profiling cam is replaced, thereby causing very large loss. Furthermore, the number of replacement parts increases and these parts are difficult to manage. In addition, adjustments by skilled technicians are required for the profiling cam replacement and can seaming operation, and the cost is difficult to reduce.

Accordingly, in recent years, where cans of different size or shape are manufactured by seaming a lid to an end portion of a can body by using a curl roller and a tightening roller, for example, a can production device such as suggested by Japanese Patent Application Laid-open No. 2001-259766 is employed as a device that uses no profiling cam. With this device, when a can of a cross-sectional shape different from a perfect round shape, for example, of an elliptical shape is processed, it is possible to conduct strain-free uniform seaming such that a curl seam processing line adapted to this can has a constant speed. This production device has a structure such that a can is produced by seaming a can body and lids at both sides of the can body in rotary dies provided at a base seat and a suppressing seat that faces the base seat and can move to and from the base seat, wherein the suppressing seat, rotary dies, curl roller, and tightening roller are coupled to respective servo motors, the cross-sectional shape and height of the can body, number of feed steps of the curl roller and tightening roller, the feed amount for each step, and the rotation speed of the rotary dies are written in a numerical control unit, and the servo motors are successively actuated based on the information written in the numerical control unit.

However, Japanese Patent Application Laid-open No. 2001-259766 mainly relates to a production device that can process cans of a cross-sectional shapes different from a perfectly round shape, such as an elliptical shape, that is used as an outer shell of an automotive muffler, and neither describes nor suggests a can seamer in accordance with the present invention that can process cans of rectangular shape or cans of different size or shape, without using a profiling cam.

Patent Document 1: Japanese Patent Application Laid-open No. 2001-259766

DISCLOSURE OF THE INVENTION

Problem to be solved by the Invention

It is an object of the present invention to provide a can seamer that does not require the replacement of a profiling cam or skilled operations, reduces the number of replaceable parts, makes it possible to simplify the replacement operation, may be adapted to various can shapes, significantly shortens the time required for the replacement operations, and may reduce labor and significantly increase productivity.

Means for Solving the Problem

The present invention has been created to overcome the above-described drawbacks. The can seamer in accordance with the present invention is characterized in including at least a chuck that fixes a can body, a curl roller, a tightening roller, a holding ring, and a guide ring that may move in X-axis and Y-axis directions, wherein the curl roller and the tightening roller are rotatably mounted opposite each other on the inside of the holding ring, and the holding ring is rotatably mounted on the guide ring. The holding ring may be mounted so as to be capable of moving horizontally, on a rotary drive ring that is disposed above the holding ring, and it is preferred that an X-axis table and a Y-axis table be mounted on the guide ring, and the X-axis table and the Y-axis table be driven by servo motors.

Effects of the Invention

As set forth in claim 1, a can seamer for manufacturing a can by seaming a lid W2 to an end portion of a can body W1 by using a curl roller 2 and a tightening roller 3 includes at least a chuck 1 that fixes the can body W1, the curl roller 2, the tightening roller 3, a holding ring 4, and a guide ring 6 that can move in X-axis and Y-axis directions, wherein the curl roller 2 and the tightening roller 3 are rotatably mounted opposite each other on the inside of the holding ring 4, and the holding ring 4 is rotatably mounted on the guide ring 6. Therefore, a profiling cam is unnecessary. As a result, when cans that differ in size or shape are seamed, the replacement of the profiling cam or skilled operations are unnecessary, the number of replaceable parts can be reduced, the replacement operation can be simplified, the device can be adapted to various can shapes, the time required for the replacement operations is significantly shortened, labor can be reduced, and productivity can be significantly increased. In particular, downtime of the automatic production line can be greatly shortened, thereby making it possible to reduce the cost.

As set forth in claim 2, where the holding ring 4 is mounted so as to be capable of moving horizontally, on a rotary drive ring 10 that is disposed above the holding ring 4, the periphery of the fixed can may be seamed in a simple manner.

As set forth in claim 3, where an X-axis table 7 and a Y-axis table 8 are mounted on the guide ring 6, and the X-axis table 7 and the Y-axis table 8 are driven by servo motors 14, 16, the guide ring 6 can be accurately shifted in the X-axis direction and Y-axis direction and moved according to the cross-sectional shape of the can body W1. As a result, seaming of cans of any shape or size can be realized.

BRIEF DESCRIPTION OF THE DRAWINGS

FIG. 5B illustrates a state in which the curl roller reached the corner from the state shown in FIG. 5A.

FIG. 5C illustrates a state in which the curl roller moves further from the state shown in FIG. 5B.

EXPLANATION OF REFERENCE NUMERALS

Figure 1:
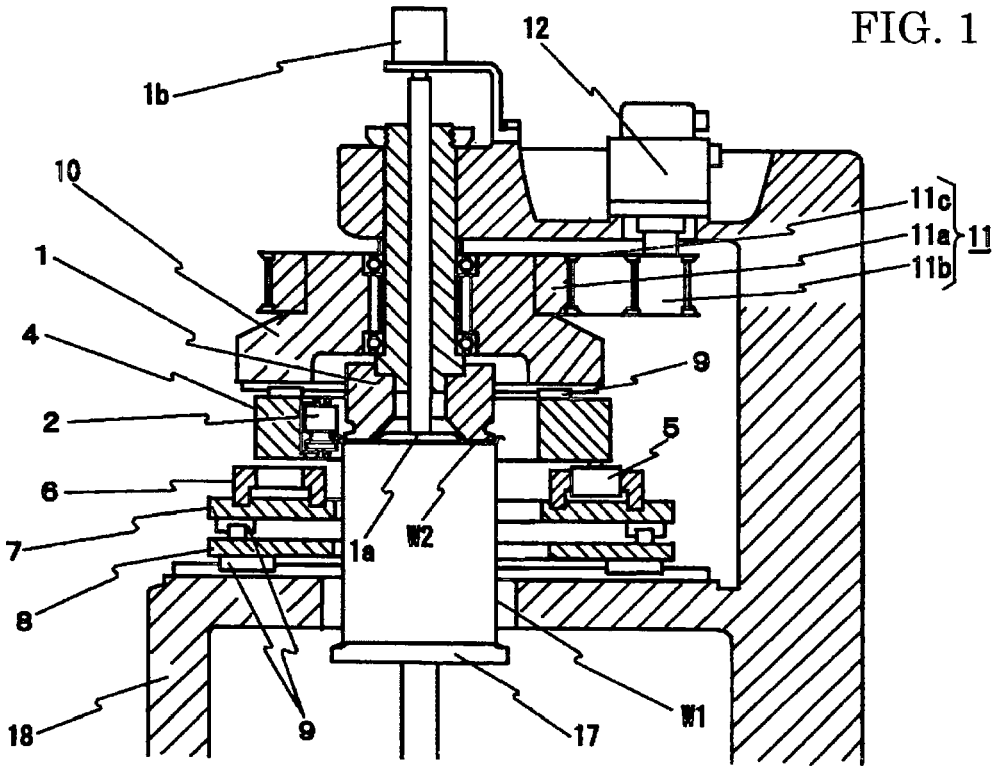
FIG. 1 is an explanatory diagram illustrating a principal vertical section of the embodiment of the present invention.

W1 can body
W2 lid
1 chuck
2 curl roller
3 tightening roller
4 holding ring
6 guide ring
7 X-axis table
8 Y-axis table
10 rotary drive ring
14, 16 servo motor

BEST MODE FOR CARRYING OUT THE INVENTION

Figure 2:
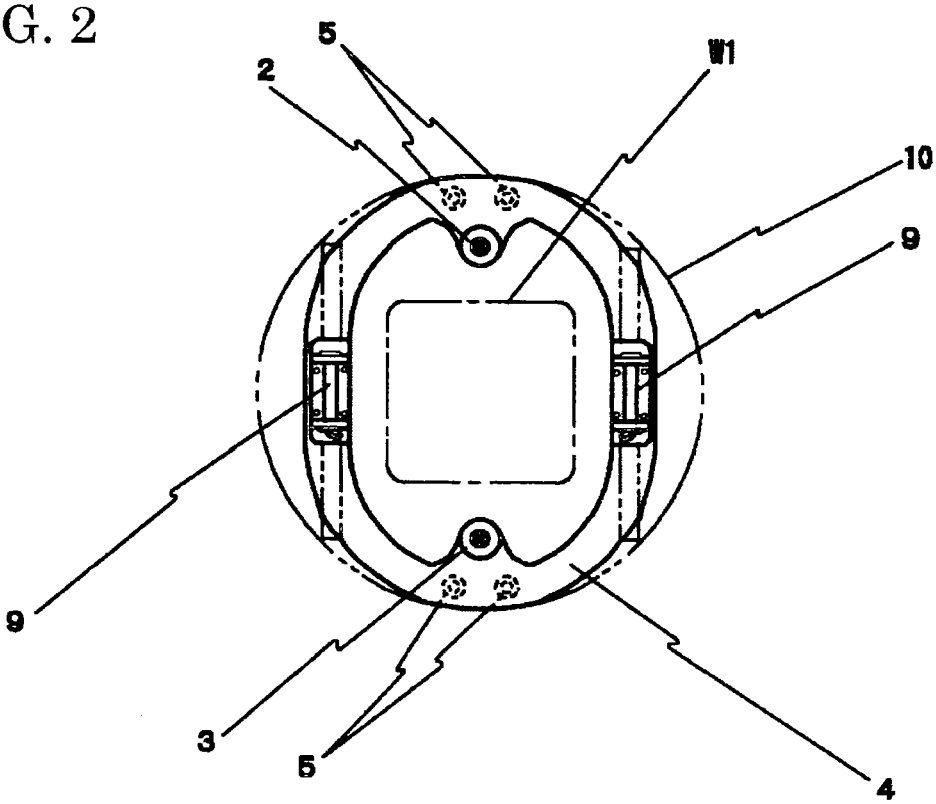
FIG. 2 is an explanatory diagram illustrating the relationship between a holding ring and a rotary drive ring in the present embodiment.
Figure 3:
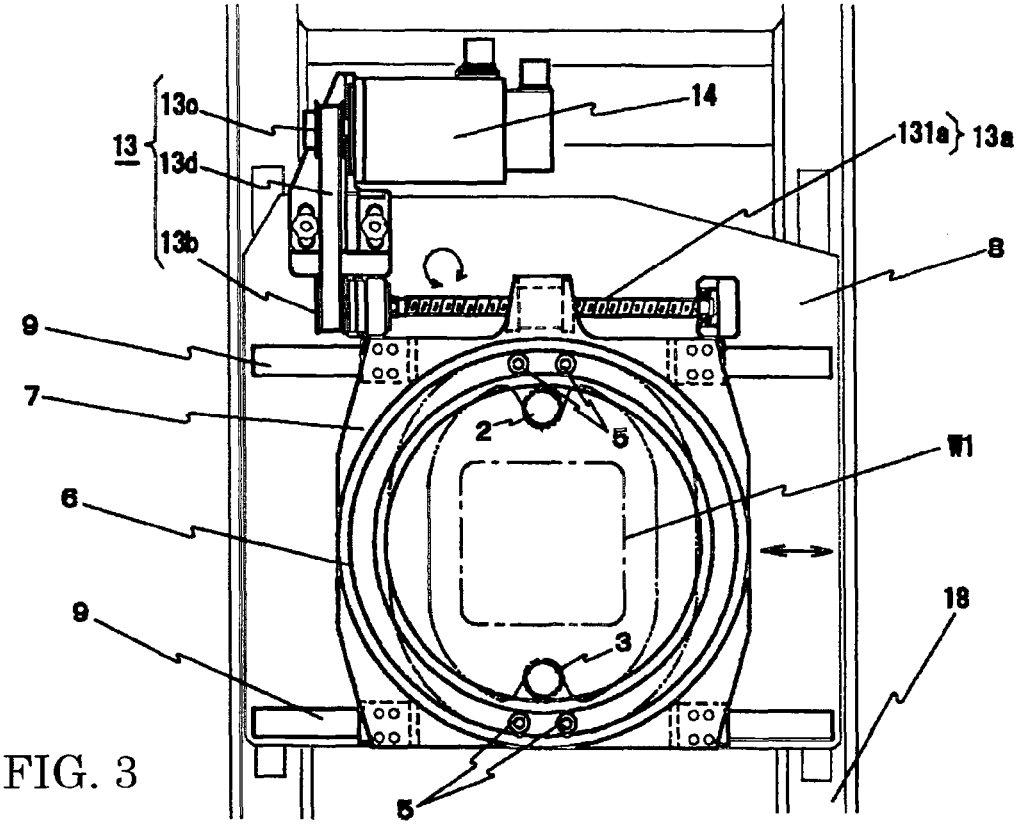
FIG. 3 is an explanatory diagram illustrating the principal plan view of a mechanism by which a guide ring of the present embodiment is moved in the X-axis direction.
Figure 4:
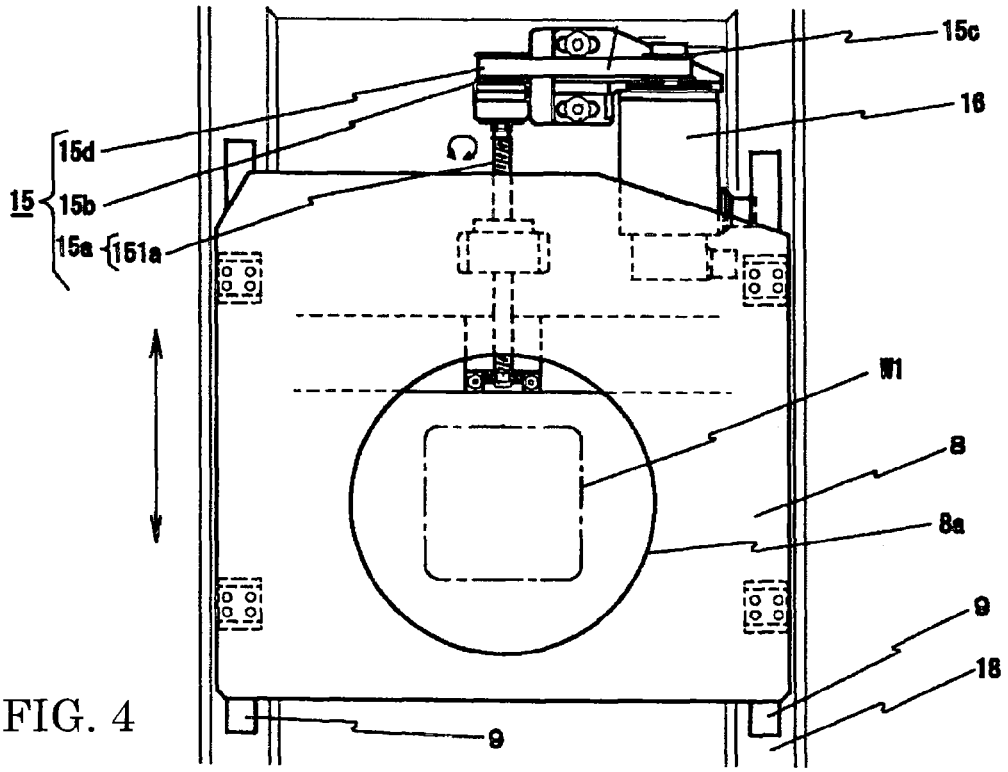
FIG. 4 is an explanatory diagram illustrating the principal plan view of a mechanism by which the guide ring of the present embodiment is moved in the Y-axis direction by a Y-axis table.

FIG. 1 illustrates an embodiment of the present invention, and the explanation below will be conducted with reference to this figure. In the figure, the reference numeral 1 stands for a chuck that fixes a can body W1. A stopper 1*a* that can be pushed in and pulled out by an air cylinder 1*b* is provided in the center of the chuck 1. The reference numeral 2 stands for a curl roller, and 3 stands for a tightening roller. The reference numeral 4 stands for an elliptical annular holding ring that holds the curl roller 2 and tightening roller 3 opposite each other and is rotatably mounted on the inner side (see FIG. 2). The reference numeral 5 stands for a pressurization roller; the pressurization rollers are disposed in pairs with respect to the curl roller 2 and tightening roller 3. The pressurization rollers 5 are mounted below the holding ring 4 and supported rotatably. The reference numeral 6 stands for an annular perfectly round guide ring provided concentrically with a round groove into which the two pairs of pressurization rollers 5 have been inserted (see FIG. 3). The guide ring 6 is provided so as to be capable of moving in the X-axis and Y-axis directions. The shape of the guide ring 6 is not limited to the annular ring shape, and may be for example an elliptical ring shape or a rectangular ring shape. The reference numeral 7 stands for an X-axis table having the guide ring 6 fixed to the upper surface thereof. A hole is drilled in the center of the table. The reference numeral 8 stands for a Y-axis table that can move perpendicular to the X-axis table 7. A hole 8*a* such as shown in FIG. 4 is drilled in the center of the Y-axis table 8. A set of two track members 9 such as linear ball rails that enable horizontal movement is provided in the left-right direction, as shown in FIG. 3, between the X-axis table 7 and Y-axis table 8, and a set of two track members 9 is provided in the forward-rearward direction, as shown in FIG. 4, between the Y-axis table 8 and a planar portion of an apparatus body 18. The reference numeral 10 stands for a rotary drive ring that is disposed above the holding ring 4. A set of two track members 9 such as linear ball rails that enable horizontal movement is provided between the rotary drive ring 10 and holding ring 4. The rotary drive ring 10 applies a rotary force to the holding ring 4, whereas the holding ring 4 can move horizontally with respect to the rotary drive ring 10.

The reference numeral 11 stands for a transmission means for rotary drive that serves to transmit the power of a servo motor 12 for rotary drive to the rotary drive ring 10. The transmission means for rotary drive 11 includes a timing pulley 11*a* that is fixed to the rotary drive ring 10, a drive pulley 11*b* that is mounted on the distal end of the servo motor 12 for rotary drive, and a belt 11*c* that connects the drive pulley 11*b* and the timing pulley 11*a*. The reference numeral 13 stand for a transmission means for X-axis movement that serves to transmit the power of a servo motor 14 for X-axis movement to the X-axis table 7. The transmission means 13 for X-axis movement is disposed therein the track member 9 for enabling the X-axis table 7 having the guide ring 6 fixed to the upper surface thereof to move smoothly in the left-right direction in FIG. 3, a horizontal movement member 13*a* that can be moved in the left-right direction by the rotation of a ball screw 131*a* is provided in the center of the track member at the X-axis table 7 of the forward portion, an X-axis pulley 13*b* is mounted on the end portion of the ball screw 131*a*, an X-axis drive pulley 13*c* is mounted on the distal end of the serve motor 14 for X-axis movement, and the X-axis drive pulley 13*c* and X-axis pulley 13*b* are connected by an X-axis belt 13*d* (see FIG. 3). The reference numeral 15 stands for a transmission means for Y-axis movement that serves to transmit the power of a servo motor 16 for Y-axis movement to the Y-axis table 8. The transmission means 15 for Y-axis movement is disposed therein the track member 9 for enabling the Y-axis table 8 to move smoothly in the forward-rearward direction in FIG. 4, a horizontal movement member 15*a* that can be moved in the left-right direction by the rotation of a ball screw 151*a* is provided below the Y-axis table 8, a Y-axis pulley 15*b* is mounted on the end portion of the ball screw 151*a*, a Y-axis drive pulley 15*c* is mounted on the distal end of the serve motor 16 for Y-axis movement, and the Y-axis drive pulley 15*c* and Y-axis pulley 15*b* are connected by a Y-axis belt 15*d* (see FIG. 4). The reference numeral 17 stands for a can lifting table that lifts the can body W1 that has been transported by a transportation conveyor, and 18 stands for an apparatus body.

The operation according to the present invention will be explained below. Initially, the mechanism of the present embodiment by which the holding ring 4 is rotated by the rotary drive ring 10 and moved in the horizontal direction will be explained with reference to FIGS. 1 and 2. First, where the servo motor 12 for rotary drive is actuated, the rotary drive ring 10 is rotated by the transmission means 11 for rotary drive. Then, the holding ring 4 is rotated via the track members 9 provided between the rotary drive ring 10 and holding ring 4. The operation of the transmission means 11 for rotary drive in this case will be described below in greater detail. Where the servo motor 12 for rotary drive is actuated, the drive pulley 11*b* mounted on the distal end of the servo motor rotates together with the motor. Further, because the timing pulley 11*a* is connected to the drive pulley 11*b* by the belt 11*c*, the timing pulley 11*a* also rotates and the rotary drive ring 10 that is integrated with the timing pulley 11*a* is also rotated. Thus, the holding ring 4 rotates via two track members 9, and the holding ring 4 can be moved horizontally by the track members 9 with respect to the rotary drive ring 10. In accordance with the present invention, the horizontal movement at this time is in the Y-axis (forward-rearward) direction.

The mechanism of the present embodiment by which the guide ring 6 is operated so that it can move in the X-axis and Y-axis direction will be described below with reference to FIGS. 3 and 4. The guide ring 6 is fixed to the upper surface of the X-axis table 7, and where the servo motor 14 for X-axis movement is actuated, the X-axis drive pulley 13*c* mounted on the distal end of the servo motor rotates, and the X-axis pulley 13*b* rotates via the X-axis belt 13*d*. As a result, the ball screw 131*a* is rotated by the X-axis pulley 13*b*, and the rotation of the ball screw 131*a* is used by the horizontal movement member 13*a* to enable the X-axis table 7 to move in the X-axis (left-right) direction in response to the rotation of the ball screw 131*a*. Thus, the guide ring 6 can be moved horizontally by the horizontal movement member 13*a* and two track members 9 disposed in the left-right direction. Further, because the guide ring 6 fixed to the upper surface of the X-axis table 7 is connected to the Y-axis table 8 via the X-axis table 7, the guide ring 6 can move with respect to the Y-axis (forward-rearward) direction. The mechanism by which the guide ring 6 is moved in the Y-axis (forward-rearward) direction in this case will be explained below. Where the servo motor 16 for Y-axis movement is actuated, the Y-axis drive pulley 15C mounted on the distal end of the servo motor rotates, and the Y-axis pulley 15*b* is rotated via the Y-axis belt 15*d*. As a result, the ball screw 151*a* is rotated by the Y-axis pulley 15*b*, and the rotation of the ball screw 151*a* can move the Y-axis table 8 in the Y-axis (forward-rearward) direction, as shown by an arrow in FIG. 4. The guide ring 6 can thus be moved along the Y-axis by the horizontal movement member 15*a* and two track members 9 disposed at the Y-axis table 8.

The structure by which a pressure is applied to the holding ring 4 by the pressurization roller 5 inserted into the groove of the guide ring 6 will be explained below with reference to FIGS. 1, 3, and 4. Because the pressurization roller 5 is in advance rotatably mounted and inserted into the groove of the guide ring 6 below the holding ring 4, where the X-axis table 7 and Y-axis table 8 move through pre-programmed distances in the X-axis and Y-axis directions, a pressurization force is applied to the holding ring 4 from the pressurization roller 5 in a state in which the pressurization roller is inserted into the groove of the guide ring 6. In this case, the rotational force is also applied, as described hereinabove, by the rotation drive ring 10 to the holding ring 4.

Figure 5A:
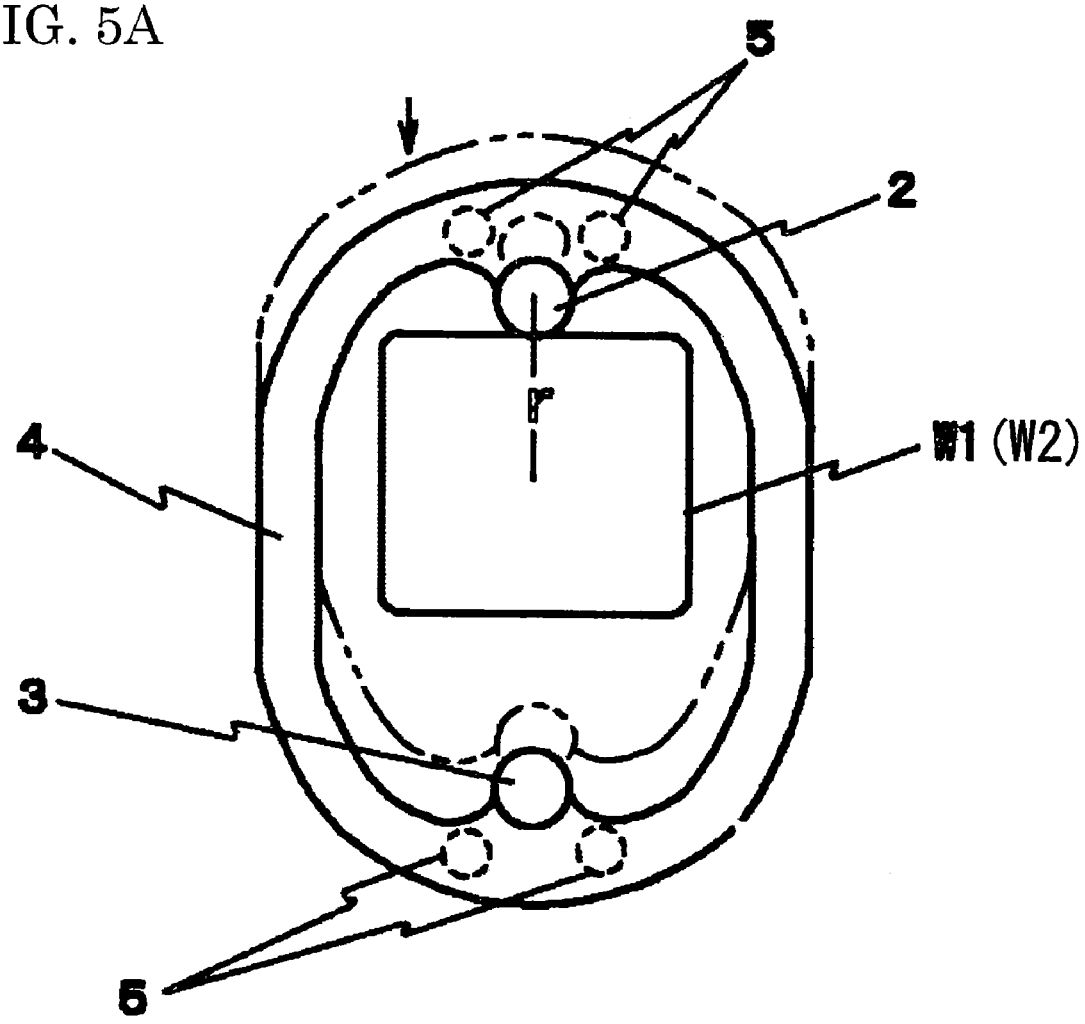
FIG. 5A is an explanatory diagram that illustrates a state in which the holding ring of the present embodiment moves along the cross-sectional shape of the can body, and that shows a state in which a curl roller starts curling the lid.

The can seaming operation conducted by using the can seamer in accordance with the present invention, without using a profiling cam, will be explained below with reference to FIGS. 5A to 5C. Where a power source (not shown in the figure) is turned on, the servo motor 12 for rotary drive, servo motor 14 for X-axis movement, and servo motor 16 for Y-axis movement are actuated, and the operation is automatically started by a preset program. In this case, the can body W1 of a tetragonal shape that has been conveyed by a conveying belt is placed on the can lifting table 17 shown in FIG. 1, the can lifting table 17 is lifted, the lid W2 is placed on top of the can body W1, and the air cylinder 1*b* is operated to position the can body W1 and lid W2 by the stopper 1*a* and fix the can body and the lid by the chuck 1. Then, the curl roller 2 supported at one end of the holding ring 4 is brought into contact with and pressed against the outer circumference of the lid W2, and curling of the outer circumference of the lid W2 is started at the top of the can body W1. In this case, the Y-axis table 8 moves rearward, the holding ring 4 moves as shown by an arrow in FIG. 5A, and the curl roller 2 is rotated, while applying a pressure, by the rotary drive ring 10, thereby starting the operation of curling the lid W2. The curl roller 2 is then moved to the right, while applying a pressure to the outer circumference of the lid W2 by the movement of the X-axis table 7 and Y-axis table 8 via the holding ring 4, pressurization roller 5, and guide ring 6. In this case, because the distance r from the center of the can body W1 to the center of the curl roller 2 gradually increases, the holding ring 4 automatically and gradually moves outward with respect to the rotary drive ring 10.

The curl roller 2 then reaches the corner of the lid W2, and when the curl roller passes the corner, the distance r gradually increases before the distal end of the corner portion and gradually decreases thereafter. Therefore, after the curl roller 2 passes the position shown in FIG. 5B, the holding ring 4 automatically and gradually moves inward with respect to the rotary drive ring 10. Then, after the curl roller 2 passes the position shown in FIG. 5C, the holding ring 4 gradually moves outward with respect to the rotary drive ring 10. The curl roller 2 thus moves along the lid W2 correspondingly to the cross-sectional shape of the can body W1 and reaches the original position shown in FIG. 5A. In this case, the pressurization roller 5 makes one revolution about the guide ring 6. The position in which curling is started is not limited to the above-described position, and curling may be started, for example, from the corner portion of the can body W1. Then, the Y-axis table 8 is moved in the direction opposite that of the arrow shown in FIG. 5A, the tightening roller 3 is brought into contact with and pressed against the curled lid W2, the upper portion of the can body W1 is seamed, and the portion of the curled lid W2 is crushed. The tightening roller 3 in this case moves almost identically to the curl roller 2. The operation of the curl roller 2 and tightening roller 3 are identical to the conventional operation. The can carry-in and carry-out operations are also substantially identical to the conventional ones. Therefore, more detailed explanation of these operations is herein omitted.

In the present embodiment of the invention, the curl roller 2 and tightening roller 3 are used separately from each other, the operation performed when the curl roller 2 and tightening roller 3 move along the outer circumferential of the lid W2, while matching the cross-sectional shape of the can lid W1, uses the servo motor 12 for rotary drive, servo motor 14 for X-axis movement, and servo motor 16 for Y-axis movement, and the control thereof is automatically performed according to the preset program. Further, with the basic control method in accordance with the present invention, by setting the distance r from the center of the can shape and the rotation angle by numerical control with the servo motors 12, 14, and 16, it is possible to adapt the device to a variety of can shapes or sizes and conduct tracing. As a result, a large number of profiling cams are not required, the conventional mechanical parts that have been required for each can become unnecessary, the replacement of seaming heads when changing a can shape is unnecessary, the required operation time can be greatly shortened, the amount of labor can be reduced, and productivity can be greatly increased.

INDUSTRIAL APPLICABILITY

As described hereinabove, the can seamer in accordance with the present invention is useful as a device for seaming cans of non-circular cross-sectional shape that is suitable for seaming cans of rectangular shape or other non-circular cross-sectional shape, without using a profiling cam, and can be adapted to cans of different shape or size by a simple operation such as setting and changing the program for drive controlling the servo motors, in particular as a seamer for seaming cans of various shapes and sizes.

The invention claimed is:

1. A can seamer for manufacturing a can by seaming a lid to an end portion of a can body by using a curl roller and a tightening roller, comprising:

a chuck that fixes the can body;

the curl roller;

the tightening roller;

a holding ring; and a guide ring configured to move in X-axis and Y-axis directions, wherein the curl roller and the tightening roller are rotatably mounted opposite each other on the inside of the holding ring, and the holding ring is rotatably mounted on the guide ring.

2. The can seamer according to claim 1, wherein the holding ring is mounted so as to be capable of moving horizontally, on a rotary drive ring that is disposed above the holding ring.

3. The can seamer according to claim 1, wherein an X-axis table and a Y-axis table are mounted on the guide ring, and the X-axis table and the Y-axis table are driven by servo motors.

* * * * *